US011129455B2

(12) United States Patent
Tseng et al.

(10) Patent No.: US 11,129,455 B2
(45) Date of Patent: Sep. 28, 2021

(54) CURVED HANDLE

(71) Applicant: Cheng Uei Precision Industry Co., Ltd., New Taipei (TW)

(72) Inventors: Chi Ming Tseng, New Taipei (TW); Tsung Shih Lee, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 16/874,874

(22) Filed: May 15, 2020

(65) Prior Publication Data

US 2021/0145141 A1 May 20, 2021

(30) Foreign Application Priority Data

Nov. 14, 2019 (CN) ..... 201921969405.0

(51) Int. Cl.
*A45C 13/26* (2006.01)

(52) U.S. Cl.
CPC ..... *A45C 13/26* (2013.01)

(58) Field of Classification Search
CPC .. A45C 13/26; A45F 5/10; B25G 3/14; B25G 3/18
USPC ..... 16/114.1, 406, 407, 408, 409, 410, 411
See application file for complete search history.

(56) References Cited

U.S. PATENT DOCUMENTS 1,977,626 A * 10/1934 Finkelstein ..... A45C 13/26 16/408
2,146,415 A * 2/1939 Bradley ..... A47J 45/08 220/753
3,289,798 A * 12/1966 Bradley ..... A45C 13/26 190/115
3,372,780 A * 3/1968 Fujioka ..... A45C 13/26 16/405
3,692,155 A * 9/1972 Laurita ..... A45C 13/26 16/114.1
4,364,150 A * 12/1982 Remington ..... A45C 13/26 16/409
4,658,467 A * 4/1987 Stolarz ..... A45C 13/26 16/114.1
4,713,860 A * 12/1987 Mobley ..... A45C 13/26 16/410
6,119,309 A * 9/2000 Lu ..... A45C 13/26 16/110.1
6,386,070 B1 * 5/2002 Hong ..... B25G 3/18 16/110.1

(Continued)

*Primary Examiner* — Jeffrey O'Brien
(74) *Attorney, Agent, or Firm* — Lin & Associates IP, Inc.

(57) ABSTRACT

A curved handle, comprising: an upper cover which is formed into a curved shape having a first accommodation space formed at a bottom thereof; a frame formed into a curved shaped and arranged in the first accommodation space, the frame being fastened to the upper cover and having a first bar and a second bar arranged at opposite ends of the second accommodation space, a plurality of upper buckle sections extended from an inner surface of the second accommodation space, a lower lid formed into a curved shaped and assembled to the frame and covered the first accommodation space to enclose the frame, the lower lid having a plurality of first lower buckle sections hooking with the upper buckle sections, the lower lid having a second lower buckle section being hooked with the first bar, the lower lid having a third lower buckle section being hooked with the second bar.

8 Claims, 6 Drawing Sheets

(56) References Cited

U.S. PATENT DOCUMENTS

| | | | | |
|---|---|---|---|---|
| 6,658,698 | B2 * | 12/2003 | Chen | A45C 13/26 16/111.1 |
| 8,191,267 | B2 * | 6/2012 | Patel | E04F 21/165 30/339 |
| 9,980,548 | B1 * | 5/2018 | Lai | A45C 13/26 |
| 2002/0056180 | A1 * | 5/2002 | Crawley | B44D 3/14 29/401.1 |
| 2006/0191946 | A1 * | 8/2006 | Lee | B25H 3/02 220/755 |
| 2006/0219508 | A1 * | 10/2006 | Hollingsworth | G06F 1/1628 190/117 |
| 2010/0052349 | A1 * | 3/2010 | Naeve | A45C 5/03 294/140 |
| 2021/0122026 | A1 * | 4/2021 | Lee | B25G 1/10 |

* cited by examiner

CURVED HANDLE

CROSS-REFERENCE TO RELATED APPLICATION

The present application is based on, and claims priority from, China Patent Application No. 201921969405.0, filed Nov. 14, 2019, the disclosure of which is hereby incorporated by reference herein in its entirety.

BACKGROUND OF THE INVENTION

1. Field of the Invention

The present invention relates to a curved handle, in particular to an assembling structure of the curved handle which is able to join the upper cover and the lower lid tightly and without gap.

2. The Related Art

Referring to FIG. 8, the conventional curved handle 100' includes an upper cover 1', a lower lid 3' coupled with the upper cover 1' to form an inner space and a frame 2' enclosed in the inner space. The frame 2' comprises a plurality of fixing hole 221', and the lower lid 3' comprises a plurality of fixing slot 35' hollowed into the lower lid 3'. Each of the fixing slots 35' is coupled to a respective fixing hole 221' for assembling the frame 2' and the lower lid 3', and a plurality of fasteners 6 respectively run through the fixing slots 35' and the fixing holes 221' to secure the frame 2' and the lower lid 3'.

However, there is no much space for the fixing slot 35' and the fixing hole 221' on two ends of the upper cover 1' and the lower lid 3' due to its curved shape, and the electrical elements arranged in the curved handle 100' further limits the design. That resulted in neither the ends of the curved handle 100' is loosen and unsecured nor the upper cover 1' and the lower lid 3' are glued together and hard to disassemble.

Therefore, it is necessary to provide an assembling structure of curved handle which is able to join the upper cover and the lower lid tightly and without gap.

SUMMARY OF THE INVENTION

The objective of the present invention is to provide an assembling structure of curved handle which is able to join the upper cover and the lower lid tightly and without gap.

To achieve said objective, the curved handle, comprising: an upper cover which is formed into a curved shape having a first accommodation space formed at a bottom thereof; a frame formed into a curved shaped and arranged in the first accommodation space, the frame being fastened to the upper cover and having a first bar and a second bar arranged at opposite ends of the second accommodation space, a plurality of upper buckle sections extended from an inner surface of the second accommodation space, a lower lid formed into a curved shaped and assembled to the frame and covered the first accommodation space to enclose the frame, the lower lid having a plurality of first lower buckle sections hooking with the upper buckle sections, the lower lid having a second lower buckle section extended from one end of the lower lid and being hooked with the first bar, the lower lid having a third lower buckle section extended from the other end of the lower lid and being hooked with the second bar.

In a preferred embodiment, the a plurality of extending first bumps are arranged in the first accommodation space, each of the first bumps has a hollowed first fixing slot, a plurality of second bumps are arranged in the second accommodation space, each of the second bumps has a fixing hole, each of the second bumps is corresponding to each of the first bumps, each of the fixing holes is corresponding to each of the first fixing slot.

In a preferred embodiment, the first bumps are set into several pairs, each pair of the first bumps has two the first bumps arranged symmetry along an elongation direction of the upper cover, and each of the second bumps is corresponding to each of the first bumps.

In a preferred embodiment, the second bumps are set into several pairs, each pair of the second bumps has two the second bumps arranged symmetry along an elongation direction of the frame, two the upper buckle sections are arranged between two pairs of the second bumps.

In a preferred embodiment, the upper buckle sections are staggered.

In a preferred embodiment, each of the upper buckle sections has an upper buckle block, each of the first lower buckle sections has a first lower buckle block, each of the first lower buckle blocks hooks with each of the upper buckle blocks.

In a preferred embodiment, the second lower buckle section has a second lower buckle block, the second lower buckle block hooks with the first bar, the third lower buckle section has a snap slot hollowed from a surface of the third lower buckle section, the snap slot is fastened with the second bar.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

In order to explain in detail, the technical content, structural features, objectives and effects of the present invention, the following is a detailed description with reference to the drawings.

Figure 1:
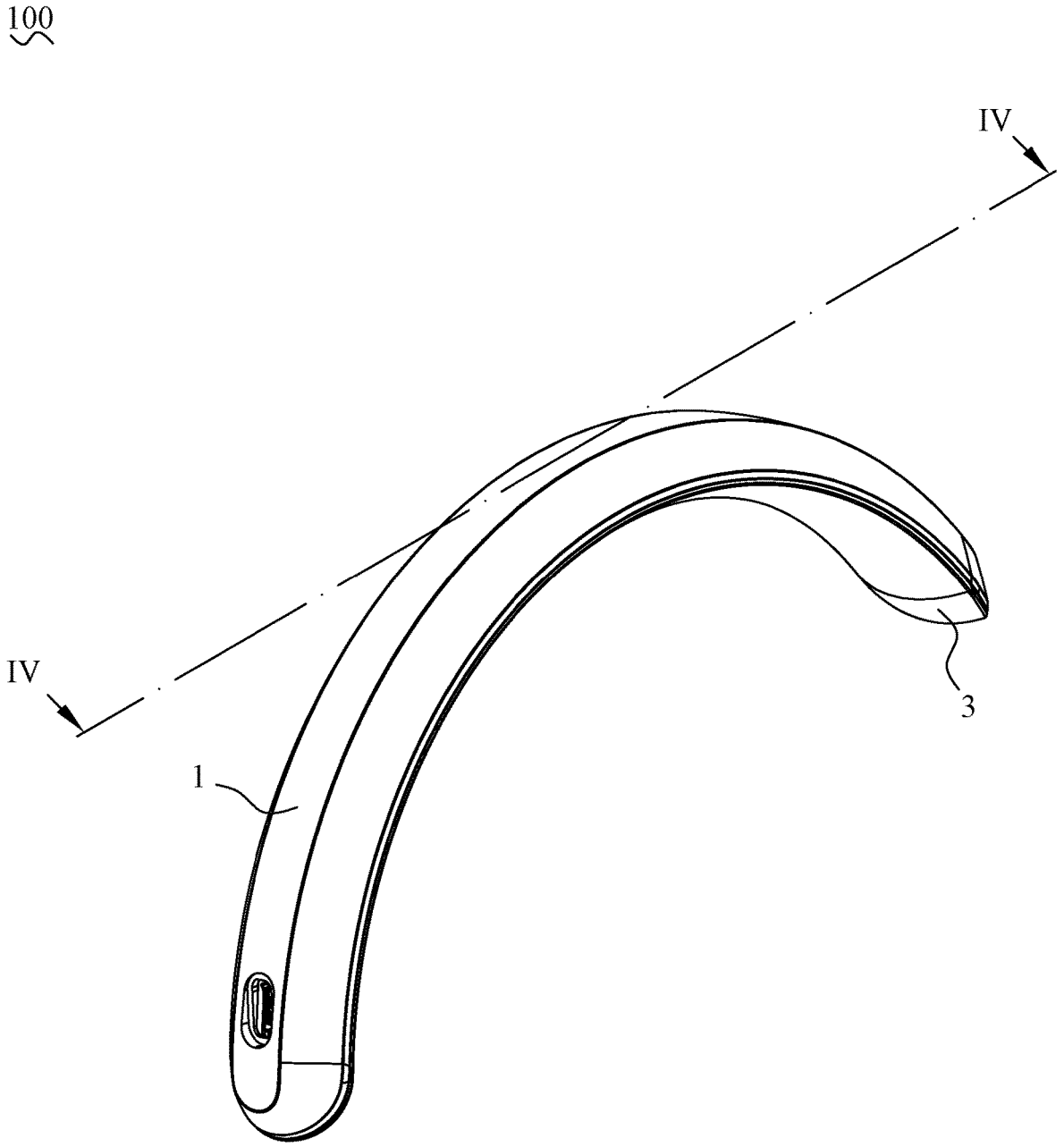
FIG. 1 is a perspective view of a curved handle in this invention.
Figure 2:
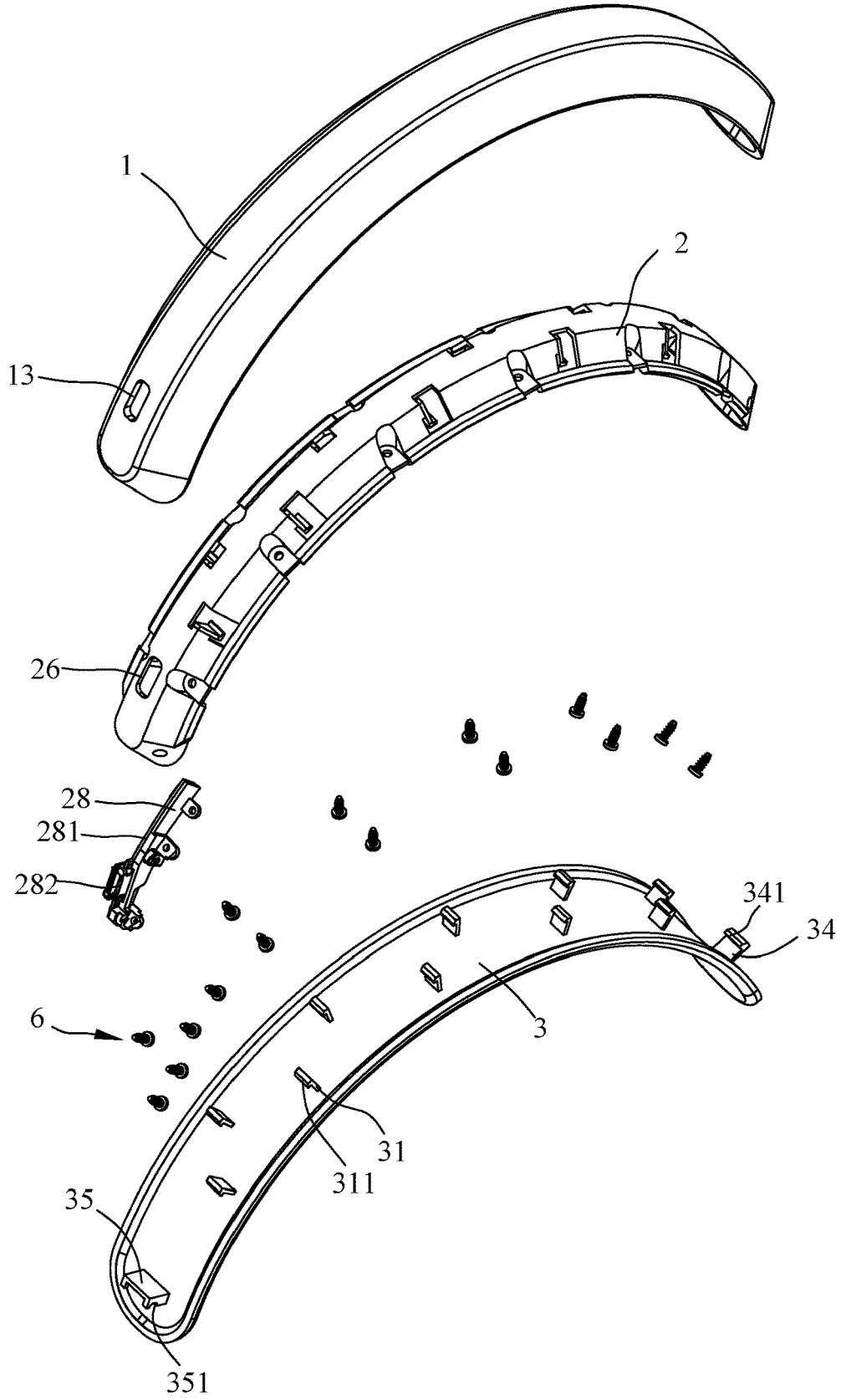
FIG. 2 is an exploded view of the curved handle in this invention.

Referring to FIG. 1 and FIG. 2, a curved handle 100 in this invention comprises an upper cover 1, a lower lid 3 coupled with the upper cover 1, and a frame 2 enclosed in the upper cover 1 and the lower lid 3.

Figure 3:
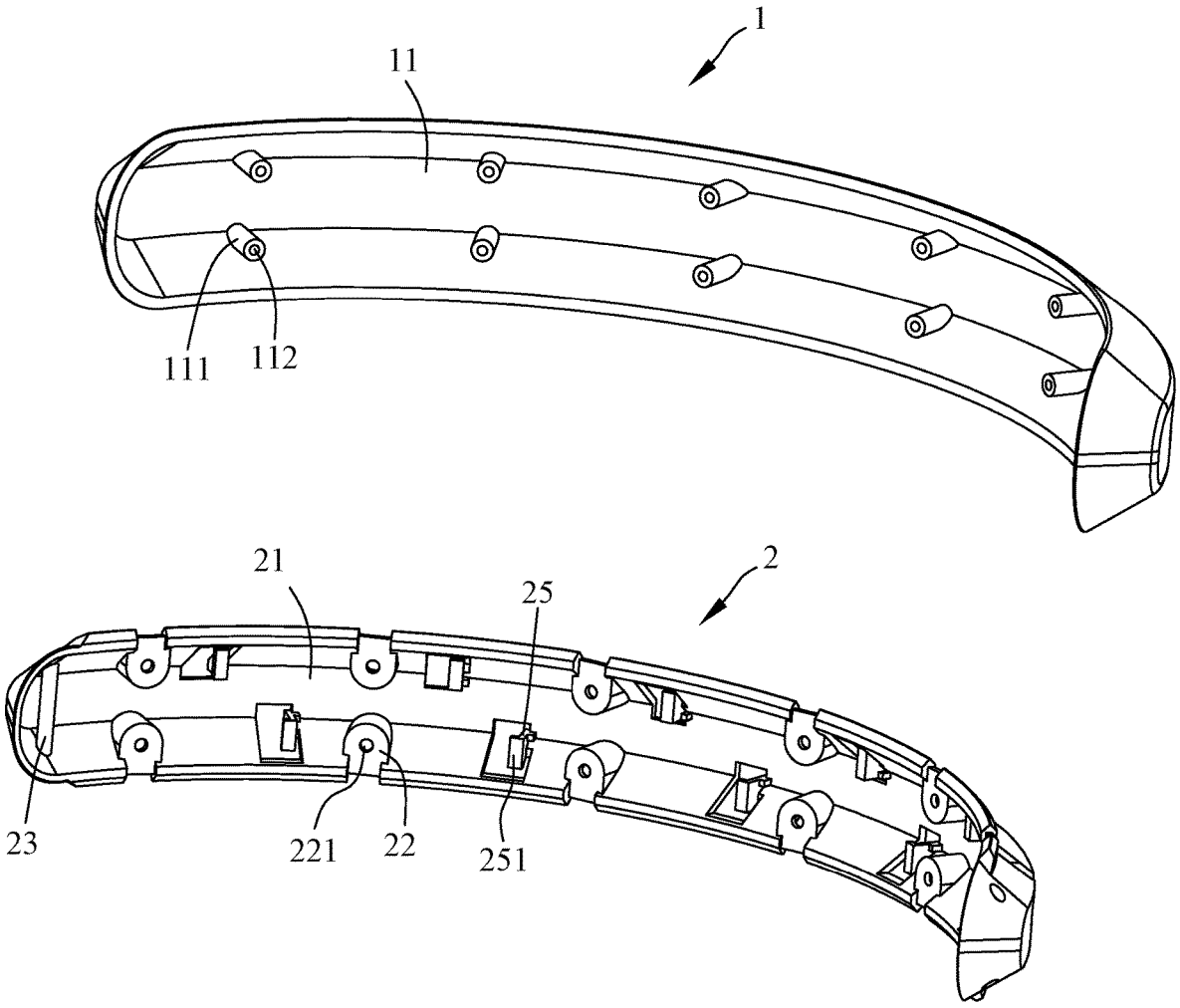
FIG. 3 is perspective view of some parts in the curved handle in this invention.
Figure 4:
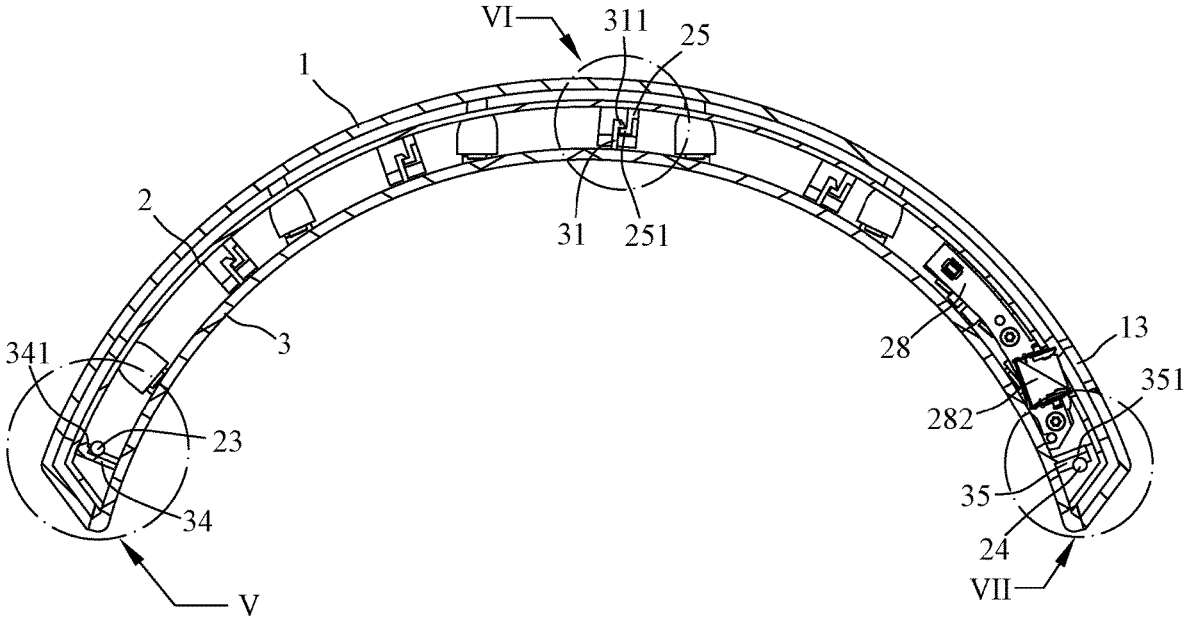
FIG. 4 is a cross-sectional view along the line IV-IV in FIG. 1.
Figure 5:
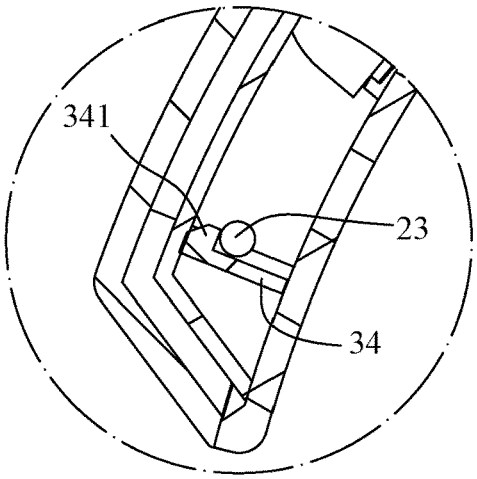
FIG. 5 is an enlarged view of circle V in FIG. 4.
Figure 6:
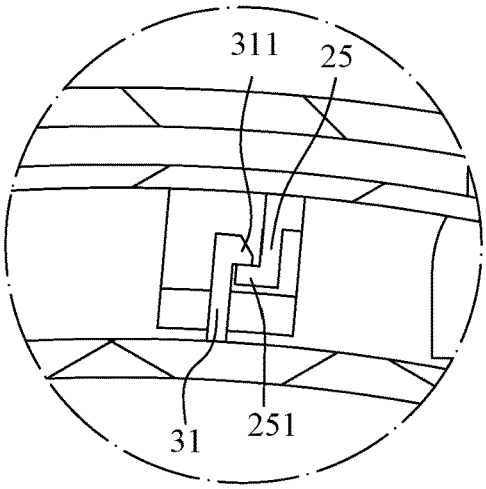
FIG. 6 is an enlarged view of circle VI in FIG. 4.
Figure 7:
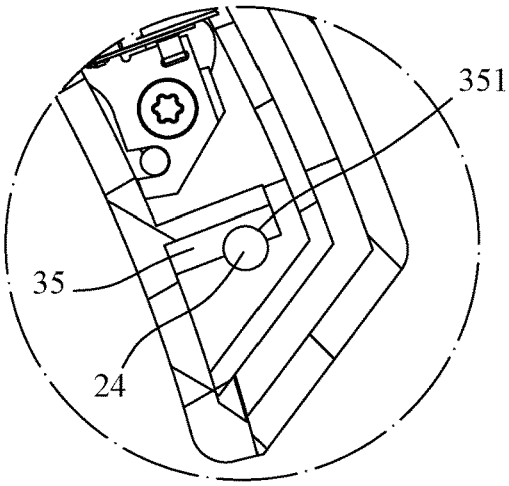
FIG. 7 is an enlarged view of circle VII in FIG. 4.
Figure 8:
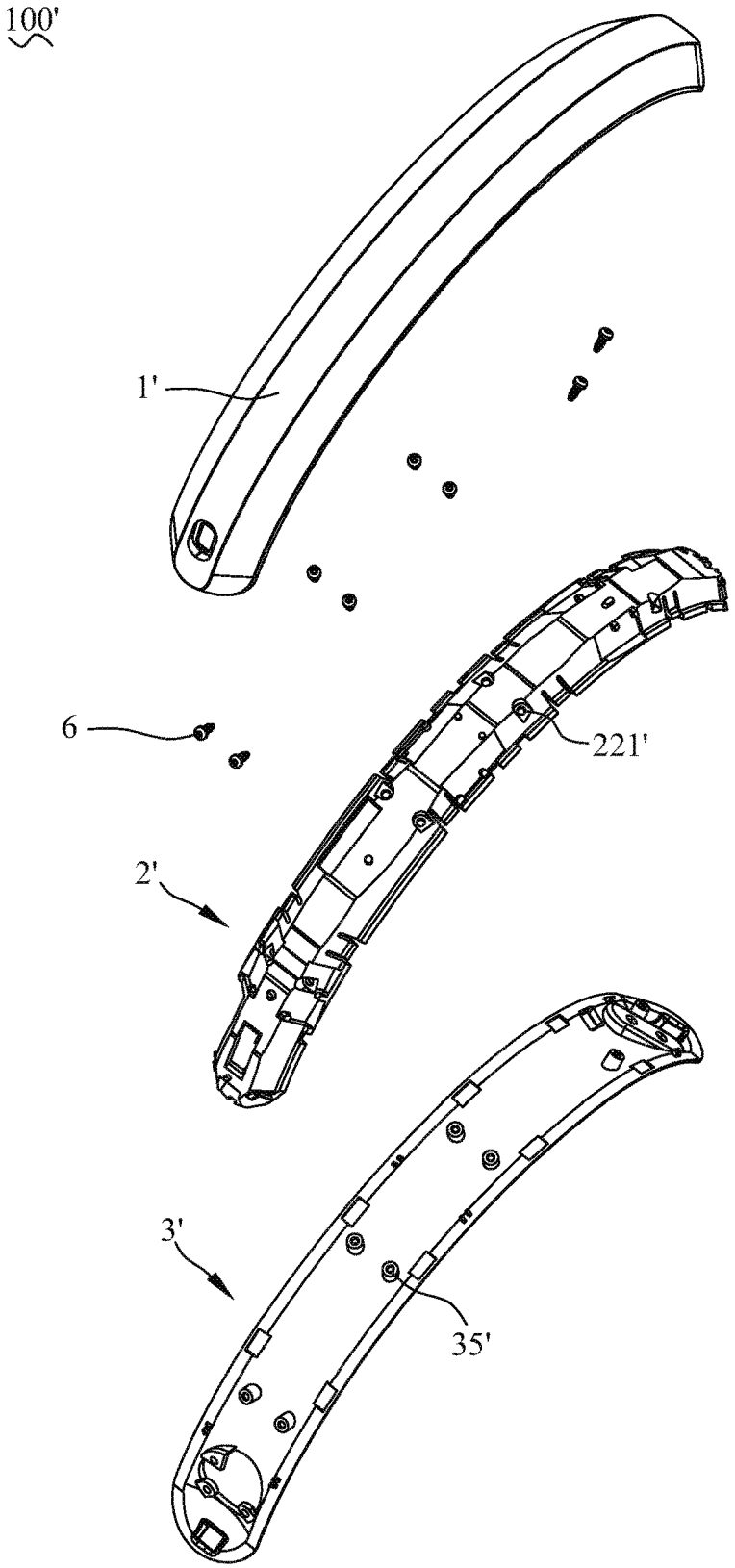
FIG. 8 (PRIOR ART)
FIG. 8 is an exploded view of a conventional assembling structure of a curved handle.

Referring to FIG. 3, the upper cover 1 is formed in a curved shape with a first accommodation space 11 at a bottom of the upper cover 1, and comprises a plurality of first bumps 111 stretched from an inner surface of the first accommodation space 11. The upper cover 1 in this embodiment comprises twelve first bumps 111 which are set into six pairs, each pair of the first bumps 111 contains two the first bumps 111 arranged symmetry along an elongation direction of the upper cover 1, and each the first bump 111 comprises a hollowed first fixing slot 112. The upper cover 1 further comprises a first external opening 13 which is located near an end of the upper cover 1.

Referring to FIG. 2 to FIG. 7, the frame 2 is arranged in the first accommodation space 11 and comprises a second accommodation space 21 formed at a bottom of the frame 2 and a plurality of second bumps 22 that stretch from an inner surface of the second accommodation space 21. The frame 2 in this embodiment comprises twelve second bumps 22 which are set into six pairs, each pair of the second bumps 22 contains two second bumps 22 arranged symmetry along an elongation direction of the frame 2, and each the second bump 22 comprises a hollowed fixing hole 221. The second bumps 22 couple with the first bumps 111 respectively, and the hollowed fixing holes 221 are align with the hollowed first fixing slots 112 respectively.

The second accommodation space 21 in this invention comprises a first bar 23 arranged at one end of the second accommodation space 2, a second bar 24 arranged at the other end of the second accommodation space 2, and ten upper buckle sections 25 extended downward from the inner surface of the second accommodation space 21, the upper buckle sections 25 are staggered. To be more specific, the upper buckle section 25 are staggered, and the upper buckle section 25 are arranged in the spacing of two pairs of second bump 22 for being arranged on the upper buckle section 25 evenly for tightly securing the frame 2 and the lower lid 3.

Each the upper buckle section 25 includes an upper buckle block 251 extended from each the upper buckle section 25. In this embodiment, all of the upper buckle blocks 251 face the same direction. The frame 2 has a second external opening 26 which is arranged corresponding to the first external opening 13. The frame 2 further comprises a support 28, the support 28 comprises a connector 282 which is arranged corresponding to the second external opening 26. Two ends of the first bar 23 and two ends of the second bar 24 connect to two sides of the inner surface of the second accommodation space 2. In this embodiment, the first bar 23 and the second bar 24 are perpendicular to the elongation direction of the frame 2. In this embodiment, all of the upper buckle blocks 251 face the first bar 23.

Referring to FIG. 2 to FIG. 7, the lower lid 3 assembled with the upper cover 1 to enclose the frame 2. The lower lid 3 includes a plurality of first lower buckle sections 31 stretched upward from the lower lid 3, and the first lower buckle sections 31 are arranged corresponding to the upper buckle sections 25. Each of the first lower buckle sections 31 comprises a first lower buckle block 311 extended outward from the first lower buckle section 31. The first lower buckle blocks 311 are arranged corresponding to the upper buckle blocks 251. A second lower buckle section 34 is extended upward at one end of the lower lid 3, the second lower buckle section 34 comprises a second lower buckle block 341 extended outward, the second lower buckle block 341 is arranged corresponding to the first bar 23. A third lower buckle section 35 is extended upward at the other end of the lower lid 3, the third lower buckle section 35 comprises a snap slot 351 hollowed from a surface of the third lower buckle section 35, and the snap slot 351 is arranged corresponding to the second bar 24.

In the assembly of the curved handle 100, the frame 2 is placed in the first accommodation space 11 to align the hollowed fixing holes 221 with the hollowed first fixing slots 112. Then each of the hollowed fixing holes 221 is secured to each of the hollowed first fixing slot 112 by running each of the fasteners 6 through each of the hollowed fixing holes 221 and each of the hollowed first fixing slot 112. In this embodiment, the fasteners 6 is a screw bolt. So, the frame 2 is secured within the first accommodation space 11 of the upper cover 1. After that, The snap slot 351 of the lower lid 3 snaps to the second bar 24, and the first lower buckle block 311 of each of the first lower buckle sections 31 snaps with the upper buckle block 251 of each of the upper buckle sections 25. In this embodiment, the first lower buckle blocks 311 snap with the upper buckle blocks 251 in order from the other end of the lower lid 3 to one end of the lower lid 3. So, the lower lid 3 is secured with the frame 2, and therefore the lower lid 3 is secured with the upper cover 1.

In conclusion, the upper cover 1 is tightly secured with the lower lid 3 by hooking the first lower buckle sections 31, the second lower buckle section 34, the third lower buckle section 35 on the lower lid 3 with the upper buckle sections 25, the first bar 23 and the second bar 24 of the frame 2 respectively.

What is claimed is:

1. A curved handle, comprising:

an upper cover which is formed into a curved shape having a first accommodation space formed at a bottom thereof;

a frame formed into a curved shaped and arranged in the first accommodation space, the frame being fastened to the upper cover and having a first bar and a second bar arranged at opposite ends of a second accommodation space, a plurality of upper buckle sections extended from an inner surface of the second accommodation space, a lower lid formed into a curved shaped and assembled to the frame and covering the first accommodation space to enclose the frame, the lower lid having a plurality of first lower buckle sections hooking with the upper buckle sections, the lower lid having a second lower buckle section extended from one end of the lower lid and being hooked with the first bar, the lower lid having a third lower buckle section extended from the other end of the lower lid and being hooked with the second bar.

2. The curved handle as claimed in claim 1, wherein a plurality of extending first bumps are arranged in the first accommodation space, each of the first bumps has a hollowed first fixing slot, a plurality of second bumps are arranged in the second accommodation space, each of the second bumps has a fixing hole, each of the second bumps is corresponding to a respective one of the first bumps, each of the fixing holes is corresponding to a respective one of the first fixing slot.

3. The assembling structure of curved handle as claimed in claim 2, wherein the first bumps are set into several pairs, each pair of the first bumps has two the first bumps arranged symmetrically along an elongation direction of the upper cover, and each of the second bumps is corresponding to a respective one of the first bumps.

4. The curved handle as claimed in claim 3, wherein the second bumps are set into several pairs, each pair of the second bumps has two the second bumps arranged symmetrically along an elongation direction of the frame, two the upper buckle sections are arranged between two pairs of the second bumps.

5. The curved handle as claimed in claim 1, wherein the upper buckle sections are staggered.

6. The curved handle as claimed in claim 4, wherein the upper buckle sections are staggered.

7. The curved handle as claimed in claim 1, wherein each of the upper buckle sections has an upper buckle block, each of the first lower buckle sections has a first lower buckle block, each of the first lower buckle blocks hooks with a respective one of the upper buckle blocks.

8. The curved handle as claimed in claim 1, wherein the second lower buckle section has a second lower buckle block, the second lower buckle block hooks with the first bar, the third lower buckle section has a snap slot hollowed from a surface of the third lower buckle section, the snap slot is fastened with the second bar.

* * * * *